US007861735B2

(12) United States Patent
Stepaniuk et al.

(10) Patent No.: US 7,861,735 B2
(45) Date of Patent: Jan. 4, 2011

(54) AUTOMATIC RETRACTABLE CANOPY FOR WHEELCHAIRS, SCOOTERS, AND THE LIKE

(76) Inventors: Karol Piotr Stepaniuk, 1 Priscilla La., Port Jefferson Station, NY (US) 11776; Hugo Israel Gallegos, 276 Froweln Rd., Center Moriches, NY (US) 11934

( * ) Notice: Subject to any disclaimer, the term of this patent is extended or adjusted under 35 U.S.C. 154(b) by 270 days.

(21) Appl. No.: 12/115,959

(22) Filed: May 6, 2008

(65) Prior Publication Data

US 2009/0277486 A1 Nov. 12, 2009

(51) Int. Cl.
*E04H 15/06* (2006.01)
*A61G 5/10* (2006.01)
*A47C 7/66* (2006.01)

(52) U.S. Cl. ..... 135/88.01; 135/88.05; 135/96; 135/66; 296/115; 280/304.1; 297/184.17

(58) Field of Classification Search ..... 135/87, 135/88.01, 88.02, 88.05, 96, 66, 65; 297/184.1, 297/184.11, 184.17; 296/65.04, 114, 115; 280/250.1, 304.1, 288.4
See application file for complete search history.

(56) References Cited

U.S. PATENT DOCUMENTS 1,172,735 A * 2/1916 Reynolds ..... 296/114
1,858,624 A * 5/1932 Arnold et al. ..... 74/625
4,671,559 A * 6/1987 Kolb ..... 296/107.09
5,168,889 A 12/1992 Diestel
5,301,975 A * 4/1994 Rivera ..... 280/304.1
5,511,259 A 4/1996 Tarara
5,695,100 A * 12/1997 O'Brien ..... 224/160
5,921,258 A * 7/1999 Francois ..... 135/88.03
6,254,116 B1 7/2001 Szumlic et al.
6,336,673 B1 1/2002 Rothe et al.
6,711,769 B1 3/2004 Jane-Prats
2008/0106126 A1* 5/2008 Ayers et al. ..... 297/184.15

* cited by examiner

*Primary Examiner*—David Dunn
*Assistant Examiner*—Danielle Jackson
(74) *Attorney, Agent, or Firm*—Scully, Scott, Murphy & Presser, P.C.

(57) ABSTRACT

A folding canopy for a mobility device, such as a wheelchair or scooter, can be displaced, via switch activation, from a folded position behind the backrest to the operating position above the mobility device. In the folded position, the canopy and structural members are kept behind the backrest. A press of the switch located on the armrest activates an electric motor and drives a mechanical assembly comprising of: two gears a shaft and two U-shape tubular structural members attached to weather resistant upholstery. The canopy and structural members assemble directly above the vehicle. Another press of the switch retracts the canopy.

17 Claims, 11 Drawing Sheets

AUTOMATIC RETRACTABLE CANOPY FOR WHEELCHAIRS, SCOOTERS, AND THE LIKE

FIELD OF INVENTION

The present invention is intended for the Home Medical Equipment (HME) industry and the Durable Medical Equipment (DME) market segment. DME includes traditional devices such as walkers, crutches, canes, traction equipment, beds, bedpans, special toilet seats, lifts, cushions, pads, scooters, and wheelchairs. The present invention is an accessory tailored for mobility devices driven by electric motors, such as wheelchairs and scooters. The invention optimizes the vehicle by adding a switch activated canopy that provides weather protection and also automatically retracts into a confined space.

BACKGROUND OF THE INVENTION

Wheelchair and scooter accessory designs that provide weather protection mainly comprise of manually mounted and operated mechanisms such as the U.S. Pat. No. 6,254,116 issued to Szumlic and Gallagher on Jul. 3, 2001. This invention comprises of a telescoping shaft with an angular disposition mechanism that allows an umbrella to be manually mounted and handled by a wheelchair-bound person. This design is adequate for a handicap person with substantial upper body mobility and function. For the handicap person who is incapable of manually inserting, opening, and maneuvering an umbrella in a shaft, a more automatic mechanism is required.

Another invention that allows an umbrella to be manually inserted into a fitting and mounted on a wheelchair is U.S. Pat. No. 6,711,769, issued to Jane-Prats on Mar. 30, 2004. The invention provides the means to manually control an umbrella with a mechanism that can rotate and swivel. The invention has a mechanism that clamps onto a pillow and provides a fitting for an umbrella. The invention was initially intended for sunbathers but is currently being marketed as a wheelchair accessory. Once again, this design is adequate for a handicap or elderly person who has substantial upper body mobility and function. A person with further limitation requires automation or assistance from a secondary party.

Sun protection accessories for wheelchairs and scooters also consist of manually mounted canopies, such as the U.S. Pat. No. 5,168,889 issued to Diestel on Dec. 8, 1992. This invention is a manually mounted and removable canopy that provides weather and sun protection for wheelchairs. It can also be manually dismantled and stored away in a cylindrical container. The task of manually mounting, assembling, disassembling and storing the canopy is labor intense and difficult for the average handicap person. Essentially, the assembly and disassembly requires the aid of an able-bodied person. Therefore, this invention does not promote independence amongst persons with limited upper body mobility.

Protective canopies are applied to different mechanisms in a variety of industries. They also range in complexity; for example U.S. Pat. No. 5,511,259 issued to Tarrara on Apr. 30, 1996 is a simple manually driven collapsible canopy for a stretcher. This invention consists of 4 U-shaped members which are pivotally joined at the same junction point on a stretcher. The purpose of this invention is to provide privacy to hospital patients that are placed on the stretcher. A comparable complex protective canopy is U.S. Pat. No. 6,336,673 issued to Rothe, Rieste, Weissmueller, and Bramsche on Jan. 8, 2002. This invention is a convertible roof for an automobile; it consists of two separate roof sections which are relocated from a stored position within the trunk space to the roof position.

Another patent is U.S. Pat. No. 5,921,258, the "Adjustable Removable Weather Shield for a Wheelchair" issued to Wade Francois on Nov. 24, 1997. This invention is a collapsible weather shield for wheelchairs; it provides a manually operated or motor activated protective canopy. The structural members relocate from behind the backrest to the operating position above the wheelchair. The flaw with this design is that it is highly conceptual and impractical. For example, the motor is directly mounted to the shaft that drives the canopy structure. This assembly is prone to mechanical failure. If the canopy is lifted, pushed, or rotated to counteract the motor's rotational force, immediate mechanical damage will occur to the motor. This is likely to happen if wind loads, human tempering or mechanical impact is applied. In addition, the canopy will be highly unstable, since the motor is the only acting braking force when the canopy is in the open or operating position and the collapsed upright position. Also, the U-shaped structural members open and retract with a spring-loaded pulley mechanism driven by the same motor. This assembly results in a highly fragile canopy. The pulley mechanism will have slack in the open position, making it prone to mechanical damage. Consequently, the spring provides an inconsistent force required to maintain the canopy structurally sound in the open position.

Other impracticalities exist in various aspects of the design. For example; the required rotational speed for the canopy to open is roughly one (1) RPM, which is slower than standard motors on the market. Therefore, a non-standard motor is required, since a step down mechanism is not shown in the design. Also, the location of the motor increases the overall width, which reduces maneuverability and makes the invention prone to mechanical damage by impact.

In general, the history of weather protection accessories for mobility devices such as power wheelchairs and scooters does not promote independence amongst individuals with limited abilities. The majority of mechanisms require from an able-bodied secondary party to exert a significant amount of work to operate them. The only invention that provides some form of automated weather protection is the "Adjustable Removable Weather Shield", which presents numerous flaws and is highly conceptual and impractical.

SUMMARY OF THE INVENTION

The present invention provides an electromechanical system designed to provide automatic sun, rain, wind and weather protection for motor driven vehicles, such as wheelchairs and scooters. The operation is best explained with a brief description of the mechanical and electrical process. In the retracted position, the structural members are joined, consequently folding the upholstery as it is kept in a confined space behind the backrest. The process begins with the single press of a switch located on the armrest. An electrical signal activates an electric motor that drives a mechanical assembly, comprised of two gears, a shaft and two tubular structural members attached to a weather resistant clothe. This sequence of events results in the linkage system relocating directly above the handicap person and wheelchair to form the structure for the upholstery and transforms into the protective canopy. If weather protection is no longer needed, another press of a switch retracts and folds the canopy behind the backrest.

DETAILED DESCRIPTION

Figure 1:
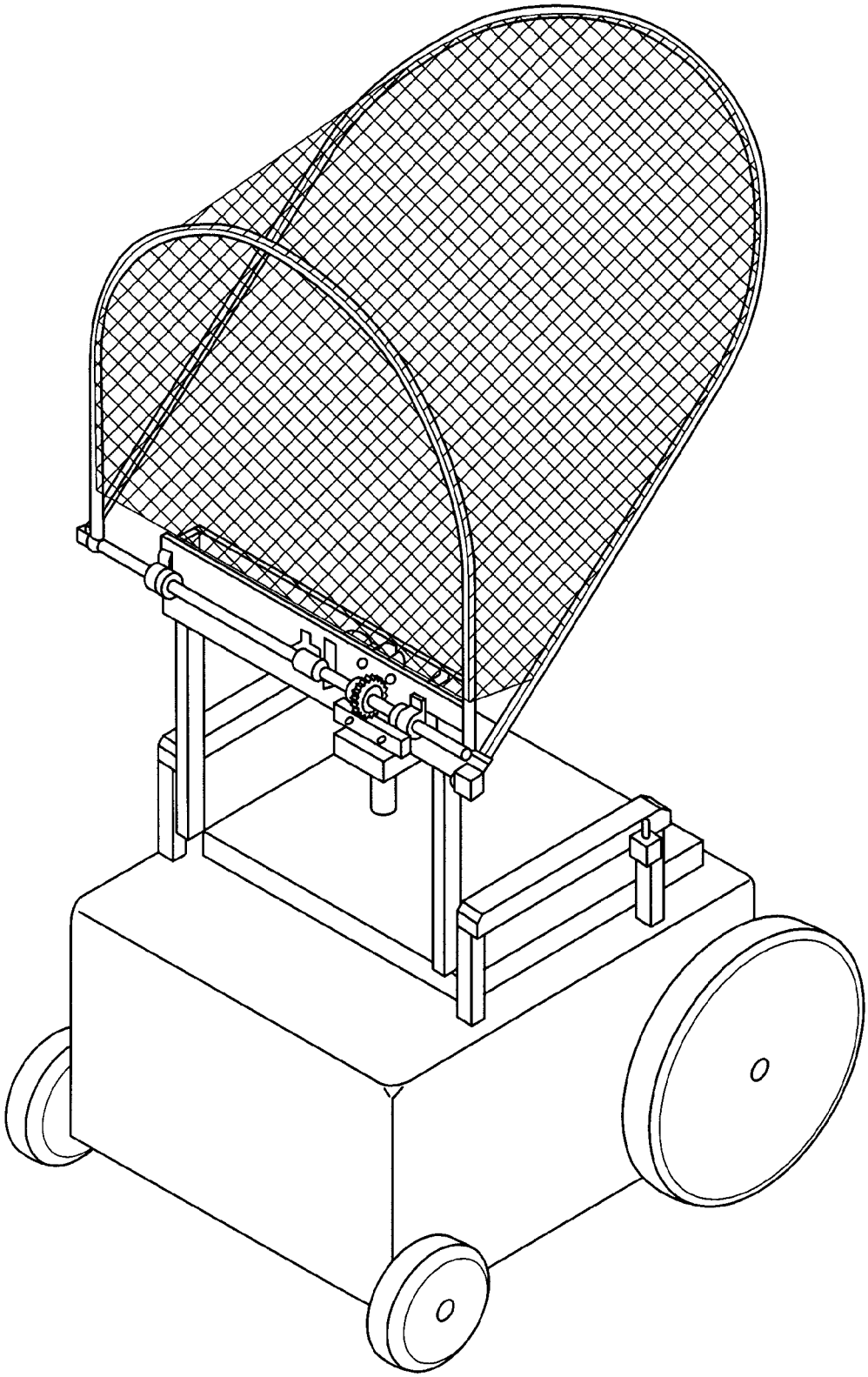
FIG. 1 is an isometric view of the canopy assembly mounted to the backrest of a wheelchair in the open position.
Figure 2:
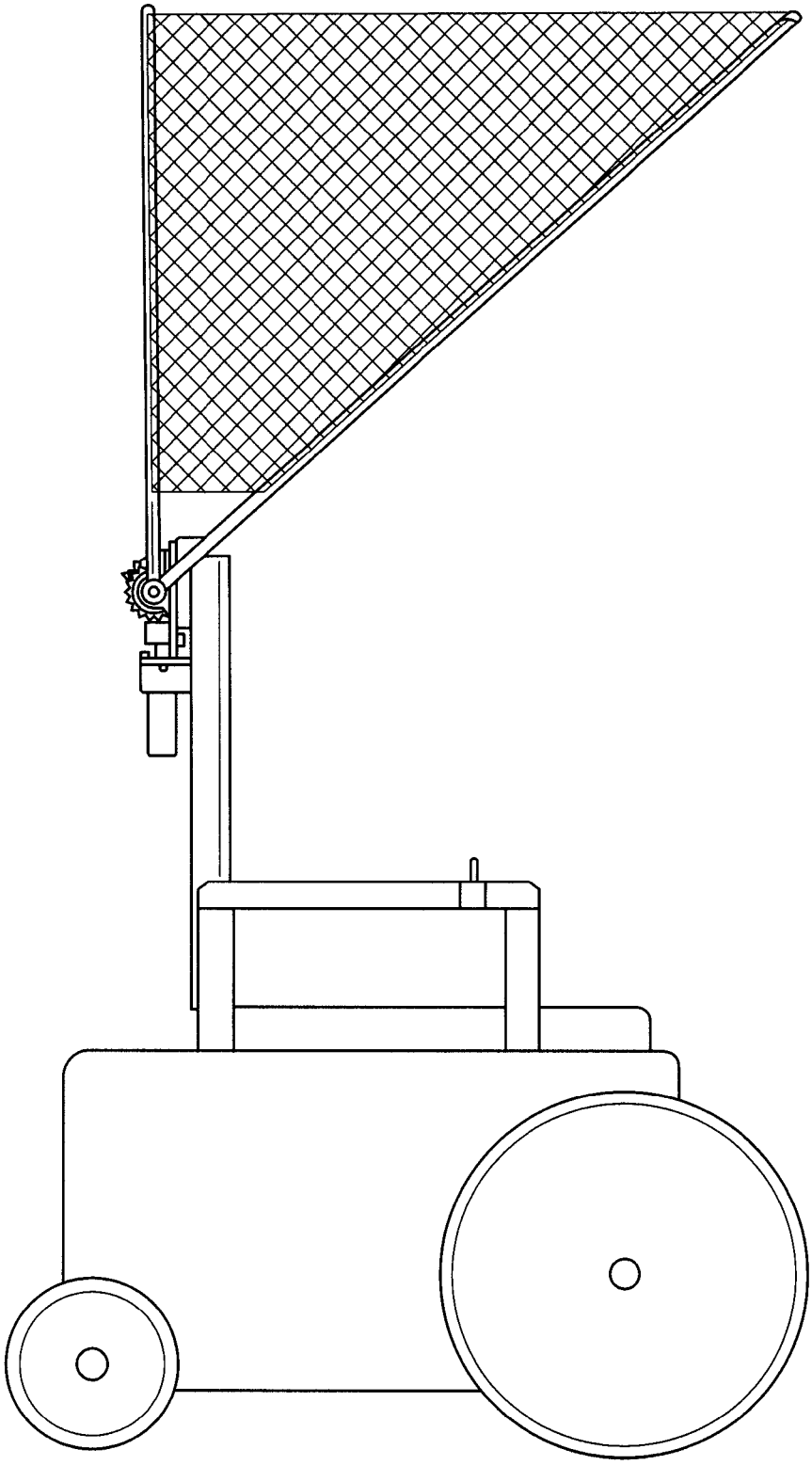
FIG. 2 is a side view of the canopy assembly mounted to the backrest of a wheelchair in the open position.
Figure 3:
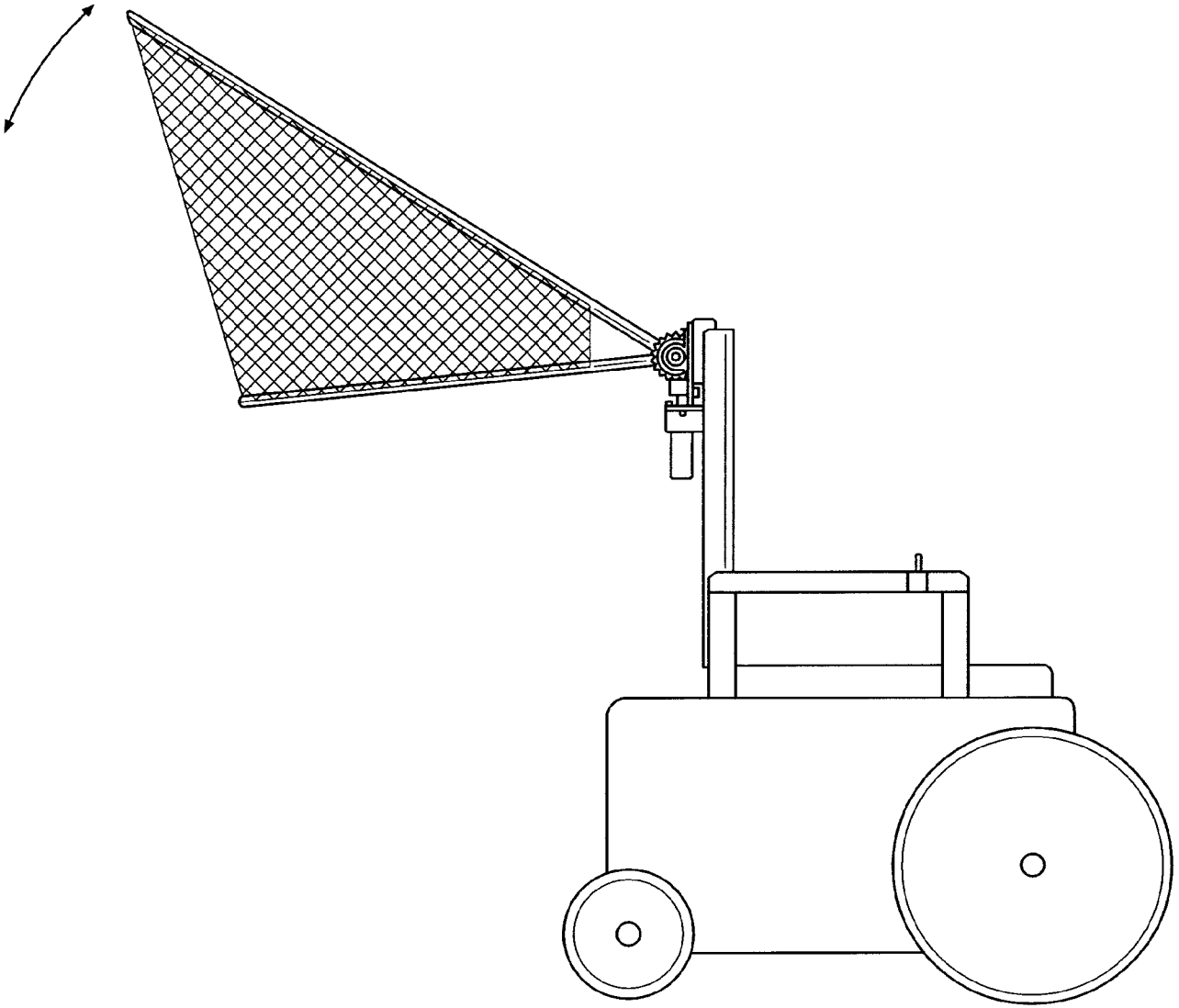
FIG. 3 is a side view of a semi-open canopy assembly that is in the process of either being opened or retracted.
Figure 4:
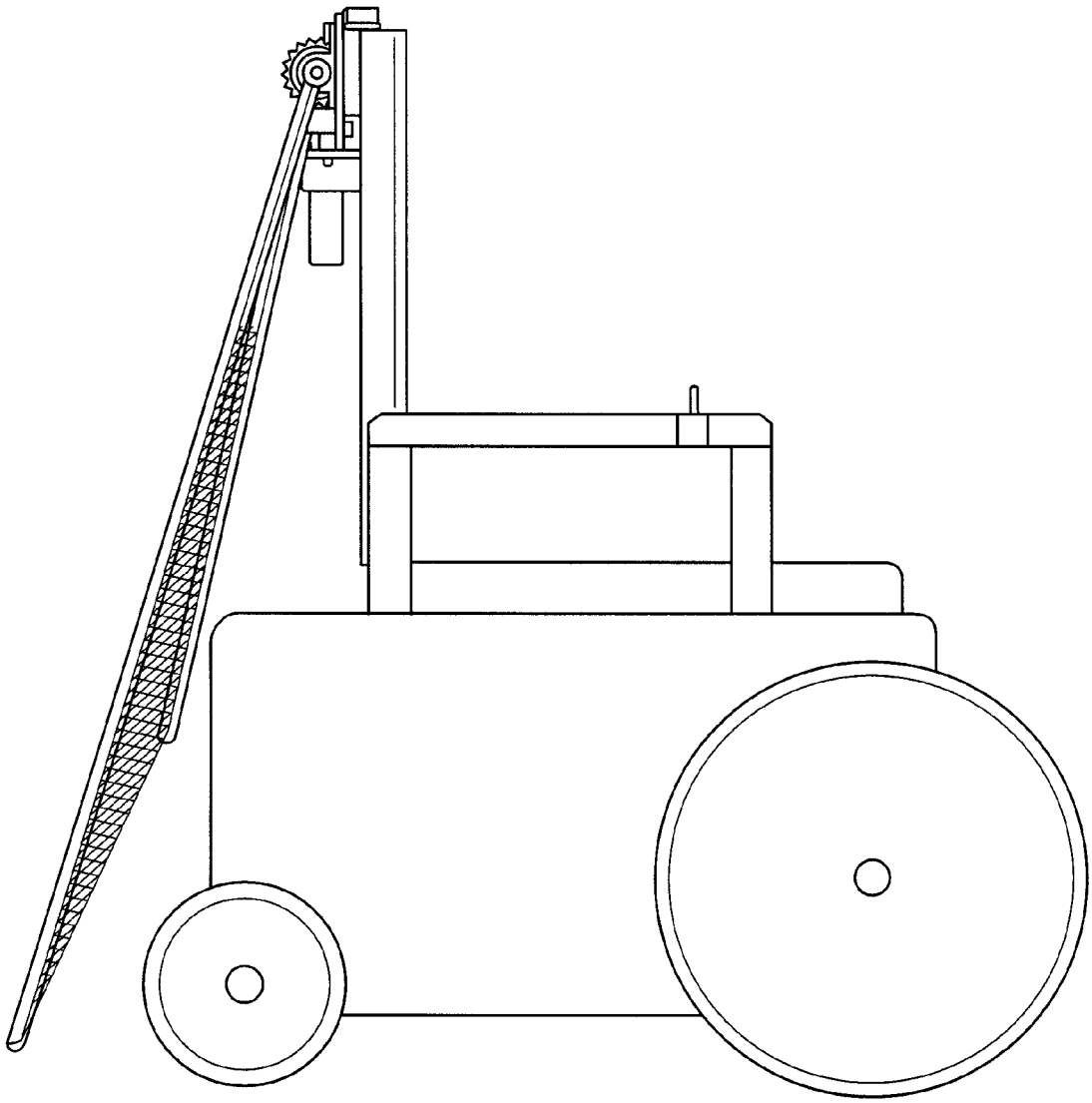
FIG. 4 is a side view of a canopy assembly mounted to the backrest of a wheelchair in the fully retracted position.
Figure 5:
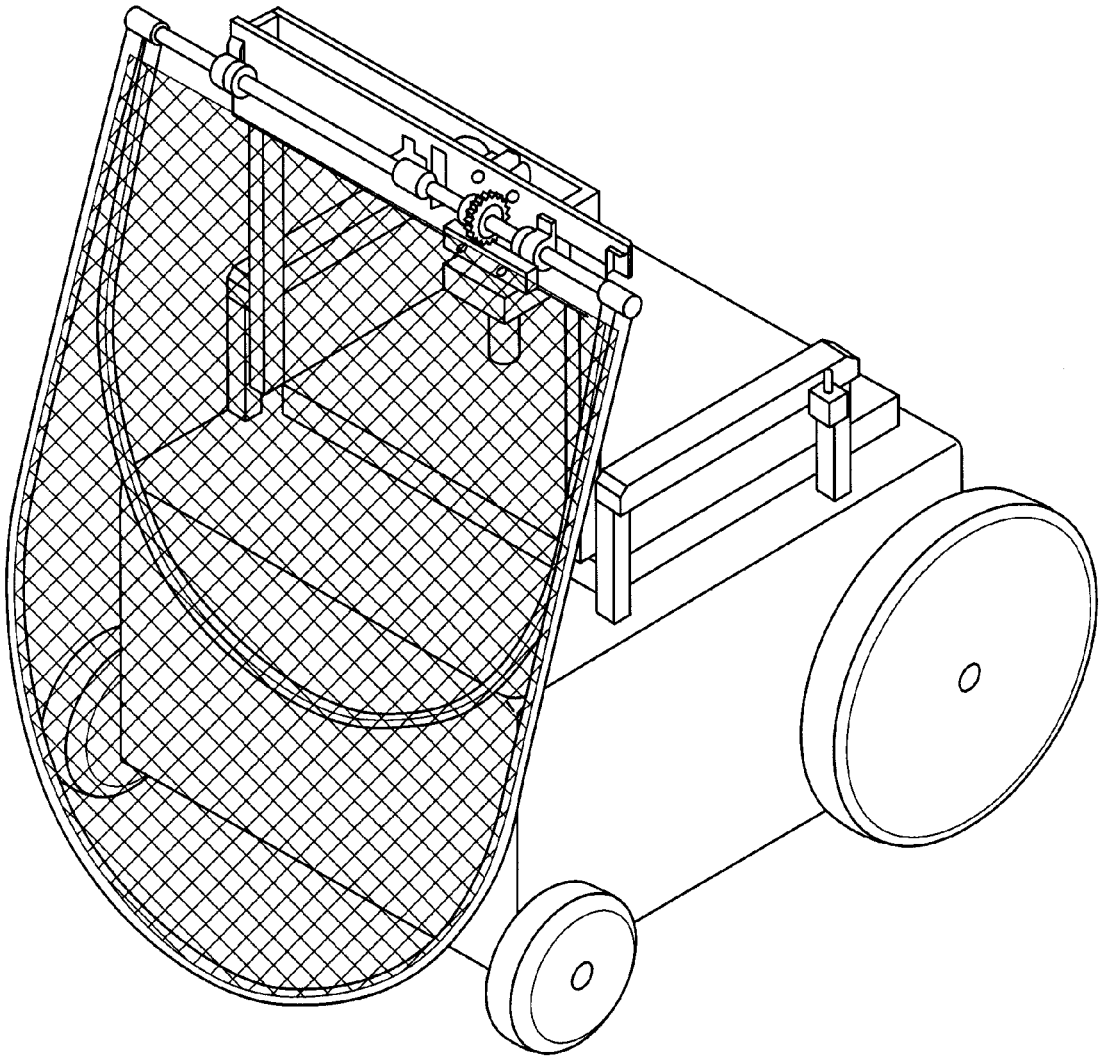
FIG. 5 is an isometric view of a canopy assembly mounted to the backrest of a wheelchair in the fully retracted position.
Figure 6:
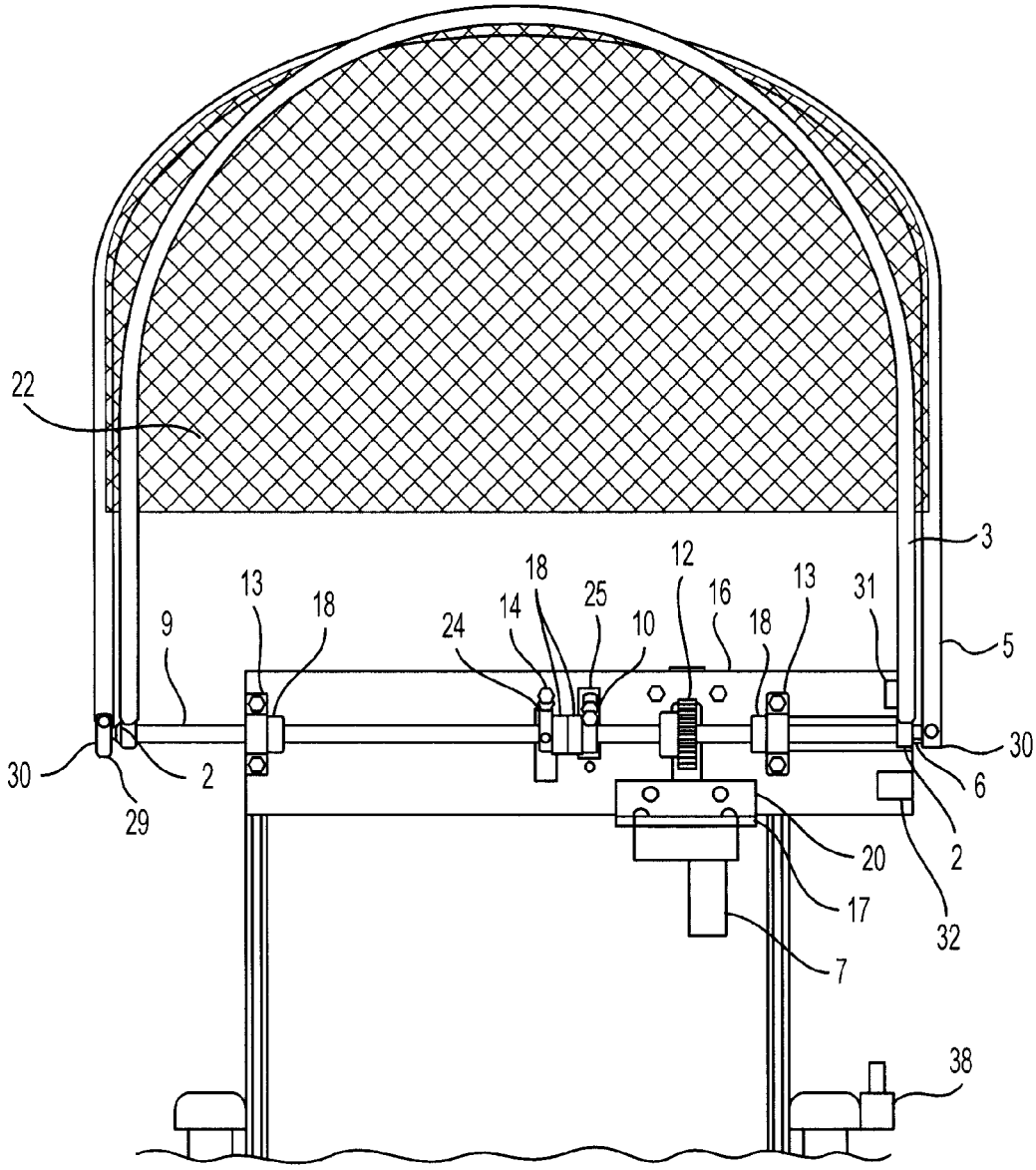
FIG. 6 is a rear detail view of the mechanical and structural assembly mounted to the backrest of a wheelchair in the open position.
Figure 11:
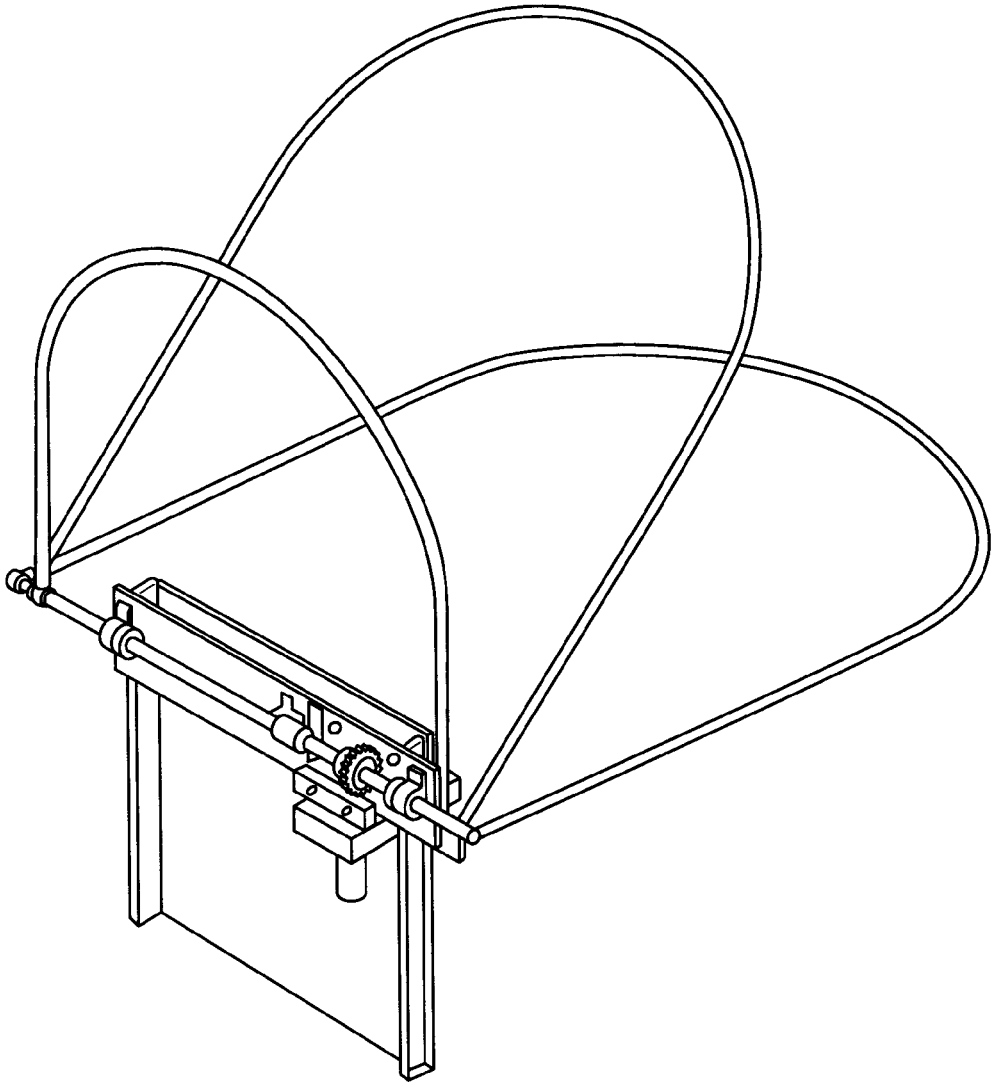
FIG. 11 is an alternate embodiment with 3 ribs, isometric view of the canopy assembly mounted to the backrest of a wheelchair in the open position.

For purpose of understanding the invention, reference will now be made to embodiments illustrated in the drawings. Whenever in general the open position or operational position is mentioned, refer to FIGS. 1 and 2. If the canopy assembly is being described as in the process of either being opening or retracting refer to FIG. 3. The generally described retracted position is shown in FIGS. 4 and 5. Refer to FIGS. 6, 7, 8, 9, and 10 for specific component references. FIG. 11 illustrates an alternate embodiment.

The whole operation of the canopy assembly is controlled by the user with a switch 38. In an exemplary model this is a three-way push switch, mounted at the wheelchair arm rest, and it is either in the open, neutral, or retract position. The three-way switch allows for the canopy operation to be stopped at any position during operation with the option to then open or retract the canopy assembly after it has been stopped. This gives the user the ability to stop the operation of the canopy at any time and then either continue in the same direction or reverse back.

The entire mechanism is mounted to the main mount bracket 16. In an exemplary embodiment, all the mechanical, electrical and structural components are mounted to the main mount bracket 16. This configuration allows simple and fast installation of the canopy assembly to the wheelchair backrest 15. Bolts attach the main mount bracket 16 to the backrest 15.

In an exemplary embodiment, the main mount bracket 16 mounting hardware 1 and 19 is specific to one kind of wheelchair with rails on the seat backrest 15. In general the main mount bracket 16 can be configured to mount to a different variety of wheelchairs, scooters or any other vehicles with a combination of specific or adjustable bolts, clamps or brackets.

Figure 7:
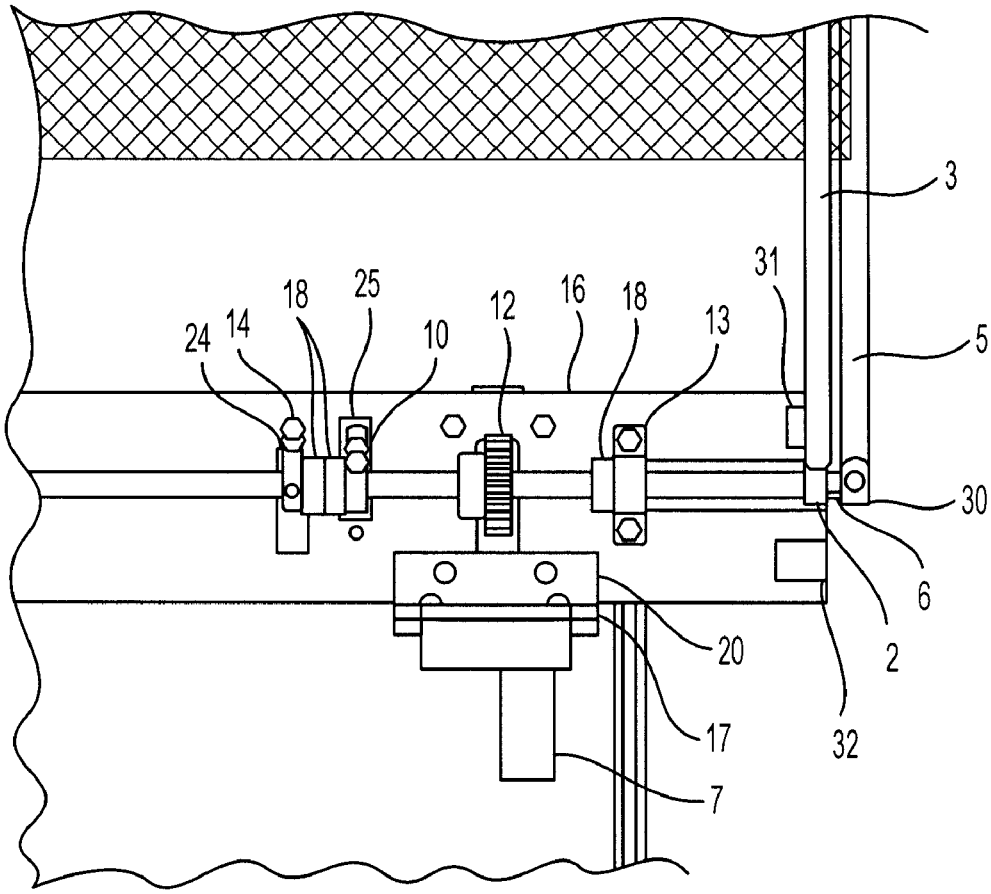
FIG. 7 is a rear close up detail view of the mechanical and structural assembly mounted to the backrest of a wheelchair in the open position.
Figure 8:
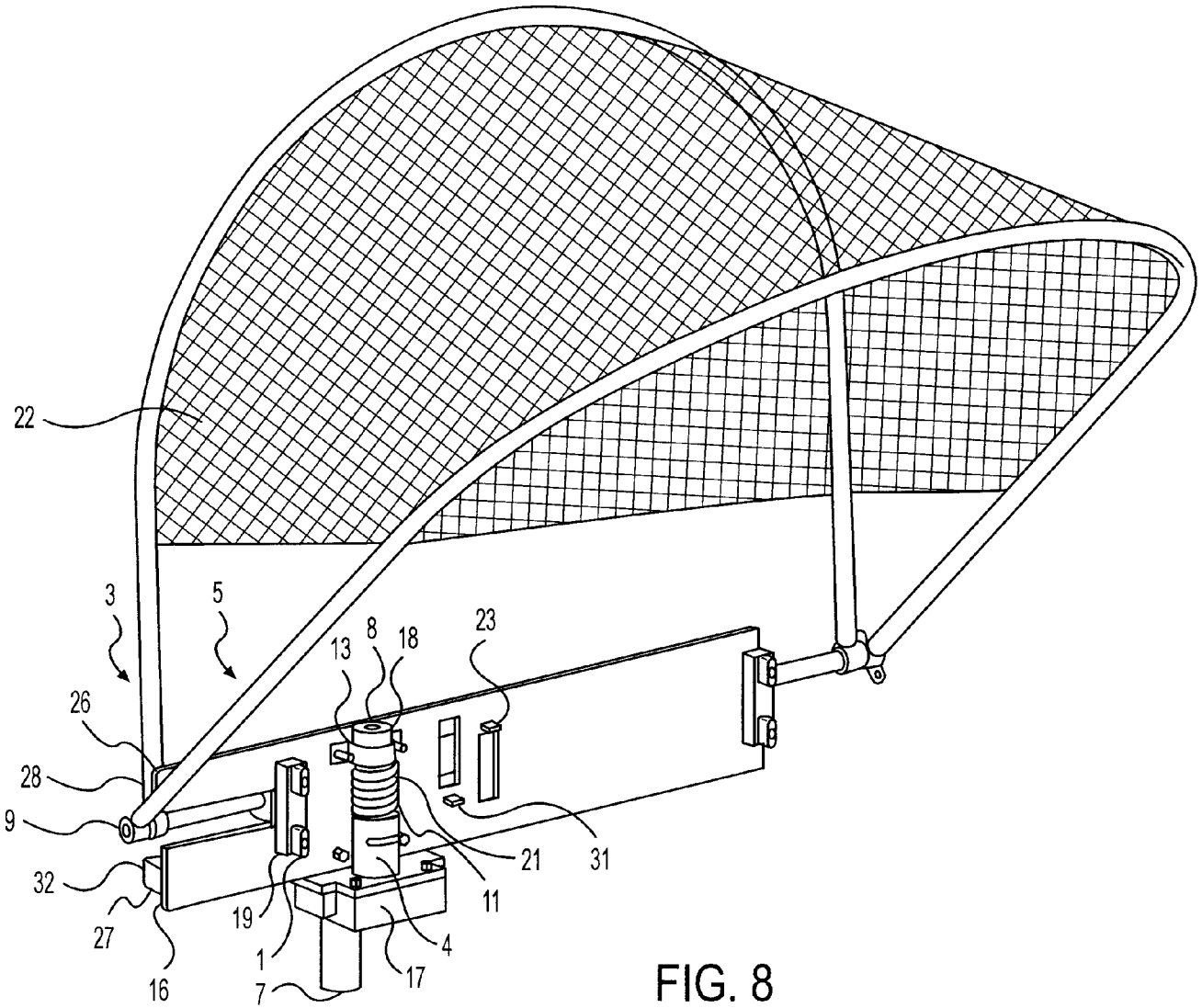
FIG. 8 is a front isometric view of the mechanical and structural assembly in the open position.
Figure 9:
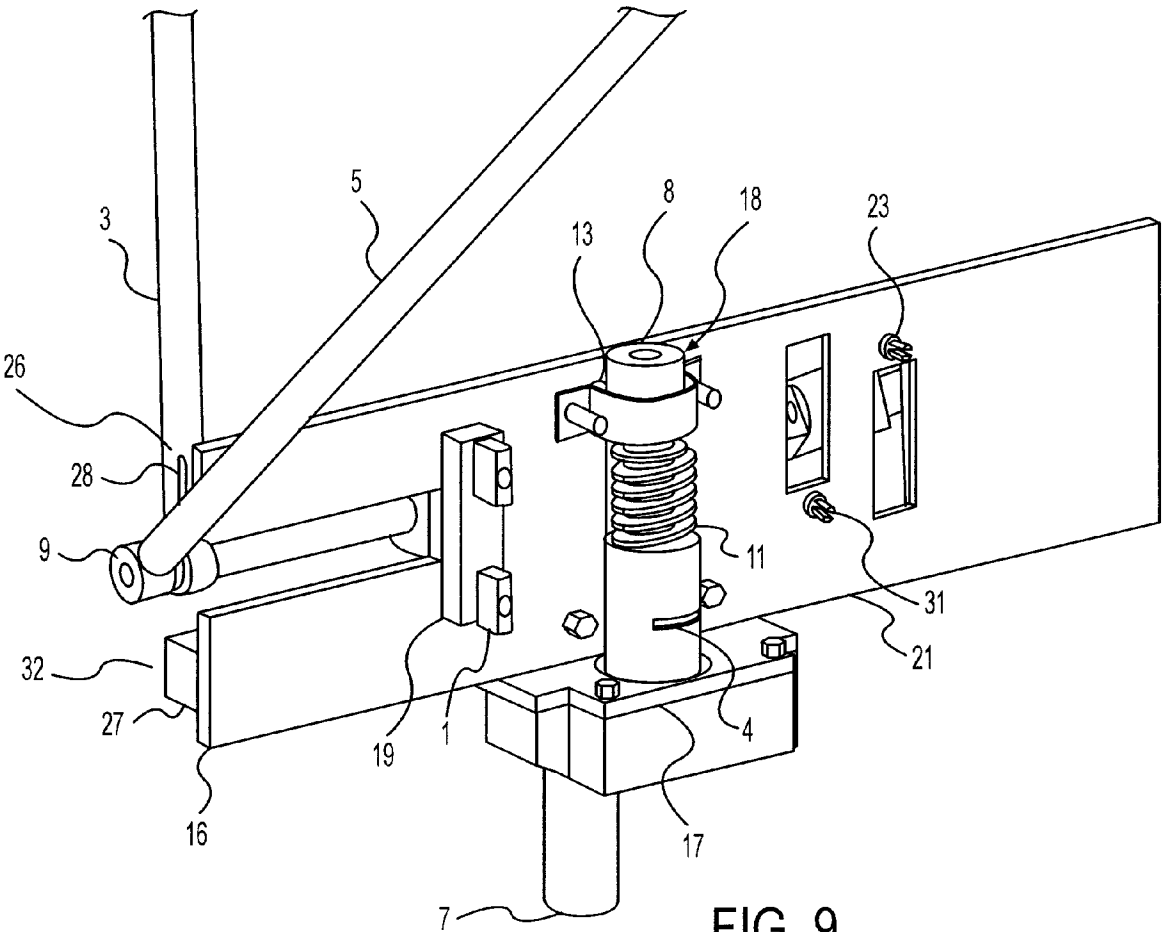
FIG. 9 is a close up of the front isometric view of the mechanical and structural assembly in the open position.
Figure 10:
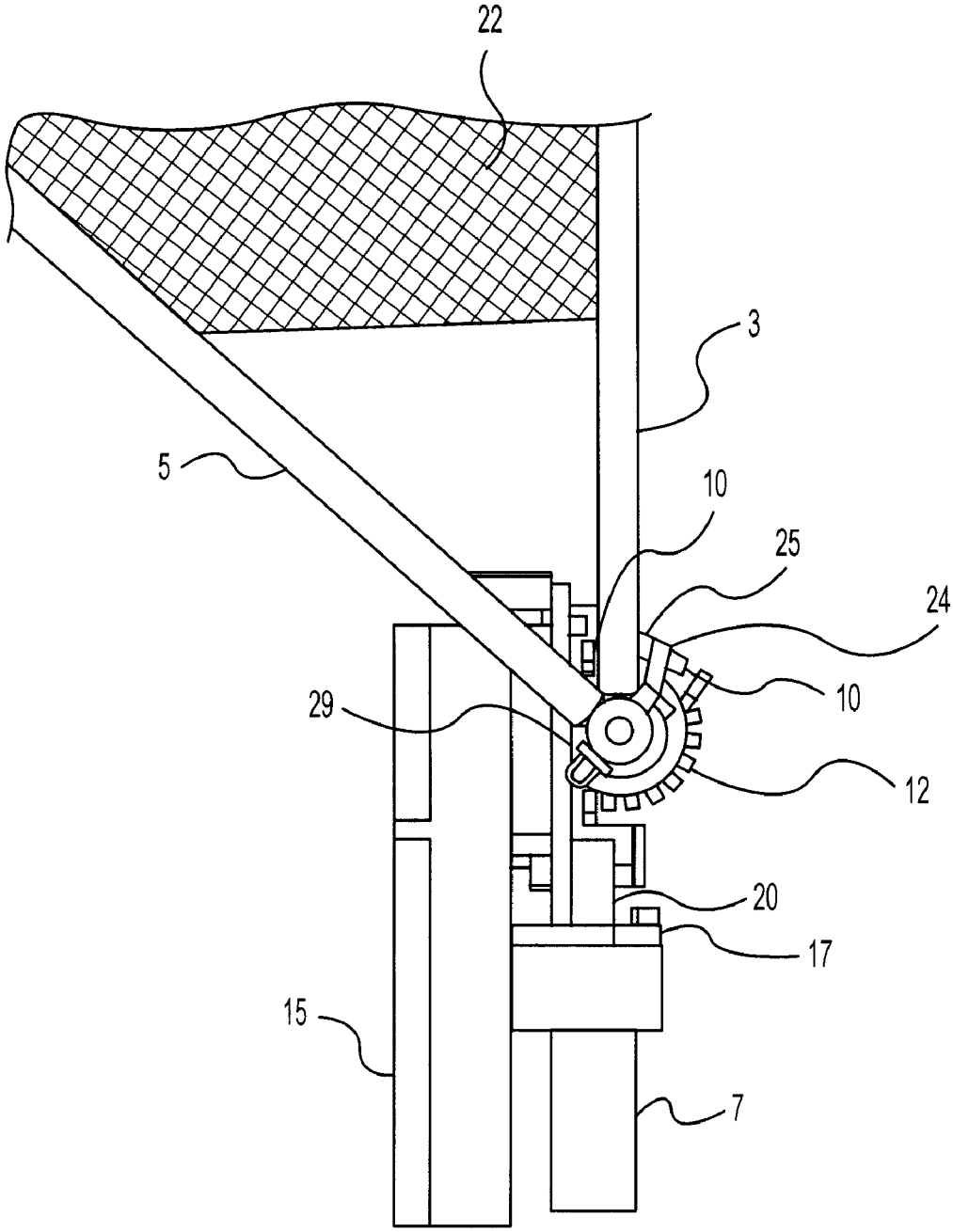
FIG. 10 is a close up side view of the mechanical and structural assembly mounted to the backrest of a wheelchair in the open position.

The motor 7 is mounted to the main mount bracket 16 by the motor mount plate 17 and the motor mount block 20. In an exemplary embodiment the motor 7 is a gear motor with a low RPM and high torque. Referring to FIG. 8, the gear motor 7 provides rotational force about the vertical axis and transfers it, with the use of a coupling 4 and worm shaft 8, to a worm 11. The worm 11, coupling 4, and worm shaft 8 assembly remains structurally sound because of the mounted bearing 13, which is bolted to the main mount bracket 16. A collar 18 that connects to the worm shaft 8 also provides structural support and alignment for the worm 11 and coupling 4 assembly. The worm 11 transfers a rotational force to the worm gear 12 and the main shaft 9 and changes the force to the rotational motion along the horizontal axis. The main shaft 9 is held in place by the main mounted bearings 13, which connect to the main bracket 16. The collars 18 provide lateral alignment for the main shaft 9, worm gear 12, main mounted bearings 13 and limiter mount brackets 24. Referring to FIG. 7, the limiter bolts 10 and 14 are attached to the main shaft 9 through the limiter mount brackets 24.

Referring to FIG. 8, the canopy assembly consists of two (2) unshaped tube ribs 3 and 5 attached to the main shaft 9. The upholstery 22 is attached to the structural members 3 and 5. The upholstery material 22 is vinyl in an exemplary embodiment but the upholstery 22 can be made out of any material that will satisfy these requirements: Water resistant if the canopy will be used for rain protection, ability to block the sun for sun protection, flexible and strong enough to withstand pulling and folding during operation.

One rib 5 is attached to the main shaft 9 through one rod end 30 and it is pinned to the main shaft 9 by a quick release safety pin 29 constraining the movement to be dependent to the rotation of the main shaft 9. The purpose of the quick release safety pin 29 is to be a safety device allowing manual canopy operation in case of a battery, motor or gear(s) malfunction. When the quick release pin 29 is pulled out, it allows free movement of the one rib 5 by removing a rigid connection between the one rod end 30 and the main shaft 9. Another rib 3 is attached to the main shaft through another rod end 2 and is allowed is rotate freely about the horizontal axis independent of the main shaft 9 rotation. Plain bearing 6 reduces friction between the other rod end 2 and the main shaft 9.

The basic operation of the canopy assembly will now be described. The electrical power to the control switch 38 and motor 7 is provided from the wheelchair batteries. In an exemplary embodiment, a power wheelchair is used that already has a battery system onboard. For example, the power wheelchair can have a mount-on battery pack (not shown) which can clamp on to the mobility device and power the automatic canopy, in addition to powering the wheelchair, for a serviceable amount of time. If the vehicle does not have its own battery system, an add-on battery pack can be installed. When the gear motor 7 is engaged by the control switch 38 at the arm rest to open the canopy, the motor 7 and main shaft 9 turn forward and the main shaft 9 lifts one rib 5 from the retracted position to the open position. This rib 5 pulls the canopy material 22 and the canopy material 22 pulls another rib 3 to the open position. When the canopy assembly is close to being in the fully open position, the other rib 3 comes in contact with the extend stop 31. This locks the other rib 3 in the vertical position and constrains any further forward movement. The first rib 5 continues to rotate and it pulls all the slack out of the canopy material 22 until the open position limit switch 23 is engaged by the open position limiter bolt 14. That cuts the forward direction power off from the motor 7 and locks the canopy assembly in the open position. The "one way" property of worm gears, e.g., worm 11 and worm gear 12, locks the canopy assembly and prevents any unintended movement of the assembly when the gear motor 7 is not operating.

When the control switch 38 is pushed to retract and engages the motor 7 to turn in the reverse direction, the main shaft 9 turns the first rib 5 again but now in the retracting direction. As the first rib 5 starts to turn the first thing that happens is tension in the canopy material 22 is released. As this rib 5 continues to rotate back, it pushes back the canopy material 22. Then the canopy material 22 pushes the other rib 3 back to the retracted position. This other rib 3 rotates until it comes in contact with the retract stop 32. Retract stop 32 prevents this other rib 3 from moving any further back. As the first rib 5 continues to move back, it compresses the canopy material 22 until the retracted position limit switch 21 is activated by the retracted position limiter bolt 10 which in turn cuts off the power to the gear motor 7 in the reverse direction. The limiter lock nuts 25 and limit switches 21, 23 combination allow manual adjustment when the limit switches 21, 23 are engaged in both the extended and retracted position. This allows the final position in the fully open and retracted position of the first rib 5 to be adjustable.

In the combination of all the components described above creates a canopy mechanical and structural assembly that is compact and simple. The combination of mechanical drive-train components and positioning of those components such as the motor 7, worm 11, worm gear 12 and mating to the main shaft 9 creates a compact drive-train that does not create any significant obstructions. In an exemplary embodiment, the gear motor 7 rotates at 25 revolutions per minute and then worm 11 and worm gear 12 reduce the rotational speed by a factor of 20 so that the main shaft rotates at approximately 1.25 RPM. The motor and gears combination result in the canopy movement from the retracted to open position and vice versa to last around thirty (30) seconds. This speed of operation creates the right balance of motion. If the ribs 3, 5 along with the canopy material 22 were to move too fast, a potentially unsafe situation could be created. On the other hand, if the operation takes too long, that would create an inconvenience for the user.

A safety system can be added to stop all moving parts in case of a mechanical jam or an obstruction, such as clothing or a body part, encountered during operation. To accomplish that a potentiometer and a motor controller can be added to the motor's 7 circuit that will detect excessive electrical current draw during operation and will prevent any further movement and will either stay stopped or back off the opposite way.

In an exemplary embodiment, the combination of the ribs 3, 5 and rod ends 2 and 30 that provide mounting to the main shaft 9 allow the canopy assembly to fit within the footprint of the wheelchair. This is a useful feature as the canopy assembly is not wider than the wheelchair itself and the wheelchair can still fit through tight spaces such as doors and narrow hallways. At the same time user space is maximized as the ribs 3, 5 and canopy material 22 shall not interfere with the person sitting in the chair. Also, ribs 3 and 5 are made out of hollow aluminum tubing that is light and flexible when excessive load is applied. As a result, when heavy wind gusts are experienced, the ribs 3 and 5 will tend to flex therefore absorbing the wind forces that might otherwise flip the wheelchair over to the side. To further reduce the wind drag forces, the canopy material 22 side and back sections can be made out of material that lets the air through such as a mesh material.

DESCRIPTION OF ALTERNATE EMBODIMENT

An alternate version of the invention is a similar design, in which instead of utilizing two (2) rib assemblies 2, 5 there can be three (3) rib assemblies. Refer to FIG. 11. As far as the mechanical system is concerned, the only difference would be the additional third middle rib and associated hardware. The additional rib 3 would function as a structural member only, allowing one rib 5 to extend further to the front. The advantage of 3 rib design is greater front protection against sun and rain. The disadvantage is a more complicated design and limiting of front and side visibility. Any canopy material 22 that is directly in the front and to the side of a user would have to be transparent.

What is claimed is:

1. A switch activated canopy which automatically opens and retracts into confined space behind the backrest of a mobility device such as a wheelchair or scooter, comprised of:

an upholstery material capable of withstanding, resisting, and repelling rain, wind, and sun;

a first structural system which attaches to and supports the upholstery material, said first structural system comprising two hollow U-shaped tubular light weight frames;

a set of rod ends that connect the U-shaped tubular links to a main shaft; a power-train operable to stabilize the canopy during operation and protect a motor by preventing unintended rotation, the power-train comprising the main shaft, a worm, a worm gear, a coupler and the motor;

a second structural system for holding mechanical and electrical components, said second structural system mounting to a variety of mobility devices and comprising a main bracket, wheelchair mount blocks, a motor mount bracket, main shaft mount bearings, a lateral alignment collar, extend stops, limiter mount brackets and limit bolts; and an electrical system operable to activate and deactivate the motor manually and automatically, said electrical system comprising a three-way control switch, limit switches for the open and retracted position, and electrical wiring.

2. The switch activated canopy of claim 1, wherein the main shaft consists of a durable, light weight metallic material capable of bearing shear, compressive, and tensional loads associated with transferring torque to the U-shaped links and absorbing unwanted vertical, lateral, rotational loads associated with operating the canopy.

3. The switch activated canopy of claim 2, wherein the limiter mount brackets and the limit bolts consist of light weight metallic brackets are clamped onto the main shaft, the limit bolt being attached to the limit mount bracket to press the limit switches at the desired rotation.

4. The switch activated canopy of claim 2, wherein said lateral alignment collars consist of metallic or plastic ring shaped clamping mechanism that mounts onto the main shaft to laterally stabilize all components mounted on the main shaft.

5. The switch activated canopy of claim 1, wherein the worm and worm gear assembly consist of metallic gears operable to stabilize the canopy in the operating position and protect the motor from undesired forces.

6. The switch activated canopy of claim 1, wherein the motor consists of a compact gear motor with a low RPM and a high torque, wherein a metallic collar connects the motor to the worm gear.

7. The switch activated canopy of claim 1 wherein the main bracket consists of a light weight metallic or plastic material where all the mechanical components are directly or indirectly mounted and supported.

8. The switch activated canopy of claim 7, wherein the main bracket further comprises a wheelchair mount consisting of at least one of a durable clamp mountable to a variety of wheelchair components, such as the handrails and backrest, and the wheelchair mount blocks inserted into rails along the backrest and connected to the main bracket with bolts.

9. The switch activated canopy of claim 7, wherein the motor mount bracket comprising comprises a light weight metallic material connecting the motor to the main bracket.

10. The switch activated canopy of claim 7, wherein the main shaft mount bearings comprise a durable light weight metallic material connecting the main shaft to the main bracket.

11. The switch activated canopy of claim 7, wherein the extend stops comprise a metallic extension on a side of the main bracket, the extend stops physically stop the motion of the U-shaped links at a desired position during an opening and retracting process.

12. The switch activated canopy of claim 1, wherein the three-way control switch comprises functions of at least open the canopy, retract the canopy, keep the canopy in a neutral position, and stop and reverse motion at any moment.

13. The switch activated canopy of claim 1 wherein the limit switches consist of two limit switches mounted onto the main bracket above and below the main shaft, the limit switches automatically shut off the motor at the canopy's desired open and retracted position.

14. The switch activated canopy of claim 1, further comprising a wind outlet screen consisting of cloth-based mesh material located on the side and rear sections of the canopy.

15. The switch activated canopy of claim 1, further comprising a mount-on battery pack which can clamp onto the mobility device and power the automatic canopy for an amount of time.

16. The switch activated canopy of claim 1, further comprising an obstruction safety system consisting of potentiometer and motor controller in the motor's circuit, the controller stops the motor in case of excessive electrical current draw due to an obstruction.

17. The switch activated canopy of claim 1, further comprising a third hollow U-shaped tubular light weight frame, made of materials such as aluminum, or plastic; which covers a larger surface area of the mobility device.

* * * * *